United States Patent [19]

English et al.

[11] Patent Number: 4,642,514

[45] Date of Patent: Feb. 10, 1987

[54] AUTOMOBILE HEADLIGHT WITH COMBINED HEAT AND LIGHT SHIELD

[75] Inventors: George J. English, Reading; Kirti B. Chakrabarti, Danvers, both of Mass.

[73] Assignee: GTE Products Corporation, Stamford, Conn.

[21] Appl. No.: 655,616

[22] Filed: Sep. 28, 1984

[51] Int. Cl.[4] ..... H01K 1/26

[52] U.S. Cl. ..... 313/111; 313/110

[58] Field of Search ..... 313/111, 112, 113, 110

[56] References Cited

U.S. PATENT DOCUMENTS

| | | | |
|---|---|---|---|
| 2,069,308 | 2/1937 | Henninger | 313/113 |
| 2,887,566 | 5/1959 | Marks | 313/111 |
| 3,191,023 | 6/1965 | Sullivan et al. | 240/41.15 |
| 3,936,686 | 2/1976 | Moore | 313/113 |
| 4,029,985 | 6/1977 | Rachel | 313/115 |
| 4,288,713 | 9/1981 | Marlor | 313/117 |
| 4,305,015 | 12/1981 | Honda et al. | 313/113 |
| 4,315,186 | 2/1982 | Hirano et al. | 313/111 |

FOREIGN PATENT DOCUMENTS

| | | |
|---|---|---|
| 2029638 | 3/1980 | United Kingdom . |
| 2079434 | 1/1982 | United Kingdom . |

*Primary Examiner*—David K. Moore

*Attorney, Agent, or Firm*—Lawrence R. Fraley

[57] ABSTRACT

An automobile headlight including a reflector, a plastic lens secured to the reflector, and a light source (e.g., tungsten halogen capsule) located within and surrounded by the reflector. Means for preventing light transmission through a preselected portion of the lens is provided, said means also substantially preventing heat buildup on the lens. In one embodiment, this means comprises a layer of mica located on the internal surface of the lens and having thereon a thin layer of aluminum. The aluminum serves as a substrate for a dark coating (e.g., black paint).

12 Claims, 4 Drawing Figures

AUTOMOBILE HEADLIGHT WITH COMBINED HEAT AND LIGHT SHIELD

TECHNICAL FIELD

This invention relates in general to automobile headlights and, more particularly, to automobile headlights wherein a plastic lens member is utilized. Even more particularly, the invention relates to automobile headlights wherein a shielding means is utilized to prevent glare to an oncoming motorist during headlight operation within the designated automobile.

BACKGROUND

Automobile headlights wherein some means is used to prevent glare are known, with some examples being illustrated in U.S. Pat. Nos. 4,288,713 (Marlor), 4,305,015 (Honda et al) and 4,029,985 (Rachel), in addition to United Kingdom Patent Application GB No. 2,029,638 A (Schmidt). In U.S. Pat. No. 4,029,985, a light-intercepting shield is mounted within the headlight immediately in front of (between light source and lens) the light source's filament. This shield, being crimped to a rigid support wire, functions to prevent direct light from the filament impinging on the lens such that only reflected light will pass therethrough. Understandably, such a structure adds appreciably to both the cost and complexity of making the headlight.

In U.S. Pat. No. 4,305,015, a light-shielding layer is located on the upper (tip) portion of the headlight's lamp capsule to prevent direct light from the capsule passing through the lens, which could cause what the patentees refer to as a "dazzling effect" to an oncoming driver. Similar tecahings are found in U.S. Pat. No. 4,288,713 and GB No. 2,029,638 A wherein the desired light source possesses a light-shielding coating on its tip portion. Understandably, such a coating must be precisely located in order to function properly, necessitating an additional, relative complex procedure in the lamp-making operation. Still further, the coating is applied directly to the lamp's envelope, which, during operation, becomes extremely hot, thus possibly adversely affecting both the coating's integrity and the envelope's cooling ability.

It is believed, therefore, that an automobile headlight possessing the several features, advantages, etc. described herein and thus overcoming the disadvantages mentioned above, would constitute a significant advancement in the art.

DISCLOSURE OF THE INVENTION

It is, therefore, a primary object of this invention to enhance the automobile headlight art.

It is a more particular object of the invention to provide a headlight wherein light-shielding is achieved without the necessity of relatively complicated shielding structures within the lamp or the application of a coating on the lamp envelope.

It is an even more particular object of this invention to provide an automobile headlight which is compact in design, is relatively simple to operate, and which can be readily and economically produced, in addition to providing the several other advantageous features cited herein, including the highly desired ability to reduce heat buildup on the lens member.

In accordance with one aspect of the invention, there is provided an automobile headlight having a reflector, a plastic lens secured to the reflector and a light source located within and surrounded by the reflector. Located on or forming part of the lens is a means for preventing both light transmission through part of the lens and the buildup of heat thereon.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

Figure 1:
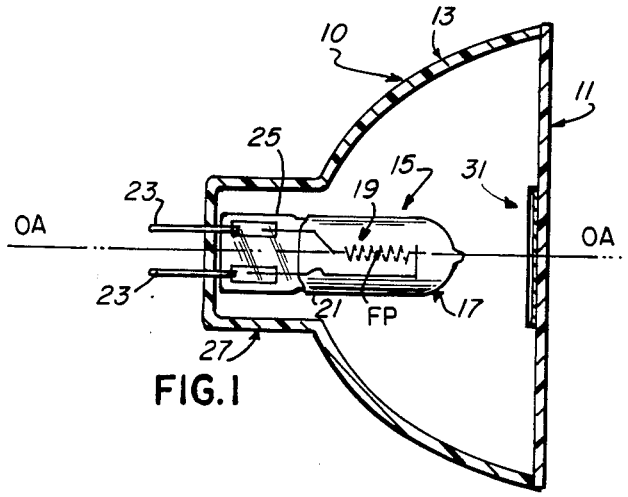
FIG. 1 is a side elevational view, partly in section, of an automobile headlight in accordance with one aspect of the invention.

Referring now to the drawings with greater particularity, there is shown in FIG. 1 an automobile headlight 10 in accordance with one embodiment of the invention. Headlight 10 may be utilized as one of the lighting modules in a multi-headlight lighting system of compact design such as described in Ser. No. 598,613, entitled "Motor Vehicle Lighting System," filed Apr. 10, 1984. As defined therein, several (e.g., four) modules are employed on each side of the vehicle such that each module can in turn utilize a low wattage light source (e.g., tungsten halogen capsule). In addition, headlight 10 may also be utilized in the vehicle lighting systems described in Ser. No. 598,614 and Ser. No. 598,615 which, like that of Ser. No. 598,613, both utilize several lighting modules (or headlights) on each side of the vehicle. In these co-pending applications, however, the individual modules each preferably include a glass front cover which is secured to the module's reflector. As such, a separate lens member, spaced from the cover, is preferably utilized. In headlight 10 of the instant invention, the lens 11 is plastic and is preferably secured to the front of the headlight's reflector component 13. Accordingly, a separate lensing element, such as required in the aforementioned co-pending applications, is not necessary when utilizing headlight 10 in a compact, multi-headlight system such as taught in the above application.

In accordance with the preferred teachings of the invention, lens 11 has an overall height (top to bottom in FIG. 1) of only about two inches to thus provide the compactness desired for a system such as described above. Although not shown, lens 11 is preferably of substantially rectangular configuration when viewed from the front of the headlight. In addition, reflector 13 is preferably paraboloidal in configuration to provide maximum reflection from the designated light source. Reflector 13 is also preferably of plastic material, and, more preferably, a polycarbonate (e.g., a plastic sold under the trademark Lexan by the General Electric Co.). Lens 11 is preferably also of this material. Yet another plastic suitable for the reflector is mineral-filled nylon. Sealing of lens 11 to reflector 13 may be accomplished by using a suitable epoxy known in the art, or alternatively, by ultrasonic welding. Using either technique, lens 11 is hermetically sealed to the reflector at the forward, open portion thereof. The various lensing elements (e.g, flutes) which function to direct the light transmitted through lens 11 in the desired manner to produce the ultimate pattern may be located on either the internal or external surface of the lens. Preferably, such elements are internally located to facilitate cleaning of lens 11 and to also substantially reduce dirt buildup on the lens outer surface as can readily occur during normal automobile operation.

The preferred light source 15 for headlight 10 is a low wattage, tungsten halogen capsule 17 which is integrally mounted within reflector 13 and substantially surrounded by the reflector's internal reflecting surfaces. By the term low wattage is meant a wattage within the range of only about ten to about twenty-five watts. Tungsten halogen lamps are well known in the art and typically include a coiled tungsten filament 19 within the capsule's glass envelope 21 and electrically connected to a pair of lead-in wires 23 which project externally of the capsule's press sealed end 25. The preferred filament 19 for capsule 17 is a coiled-coil (CC) filament which lies along the envelope's longitudinal axis. Alternatively, a coiled-coil tungsten filament lying orthoganal to this axis may be utilized. In either case, the filament is located within the reflector such that the reflector's focal point (FP) is substantially centered thereon. This in turn assures maximum light output to the designated reflecting surfaces.

Light source 15 is hermetically sealed within reflector 13. This may be accomplished by providing a pair of apertures within the reflector's neck portion 27 and passing the lead-in wires 23 therethrough. These wires may then be sealed by ultrasonic welding after correct alignment of the capsule's filament 19 has occurred. As also seen in FIG. 1, capsule 17 is oriented such that filament 19 lies along the optical axis OA or the reflector. Although there has been shown and described a capsule containing only one filament therein, it is within the scope of the invention to utilize a light source wherein more than one filament is employed. It is, of course, also understood that the teachings of the invention may be adapted to automobile headlights wherein a glass reflector is used. The teachings herein are thus not limited to plastic reflector headlamps nor to those using only tungsten halogen capsules as the light source therein.

In accordance with the teachings of the instant invention, there is provided a means 31 located on or forming part of a preselected portion of lens 11 for preventing the transmission of light through this portion in order to reduce glare to an oncoming motorist when headlight 10 is in operation within an automobile. As will be defined, means 31 is also capable of preventing heat buildup on lens 11 during headlight operation, which heat buildup could in turn alter the lens configuration (e.g., planar, as illustrated) and thus adversely affect functioning thereof. Means 31 is preferably centrally located on an internal surface of lens 11 such that the optical axis OA—OA of reflector 13 passes therethrough. In such an arrangement, the tip (upper) portion of envelope 21 is facing means 31 and thus located relative (adjacent) thereto. In operation, light passing through the tip or upper portion of envelope 21 is prevented from directly passing through the central portion of the lens by means 31. This is deemed important because light passing through the envelope's tip portion is of uneven distrubution and as such unacceptable for direct transmission through a lens. Provision of means 31 for substantially preventing this transmission thus serves to substantially reduce glare to an oncoming motorist. Because means 31 is centrally disposed on lens 11 relative to lamp 15, it is also able to substantially prevent much of the heat emitted by the tip portion of the lamp from building up on the central portion of the lens.

Figure 2:
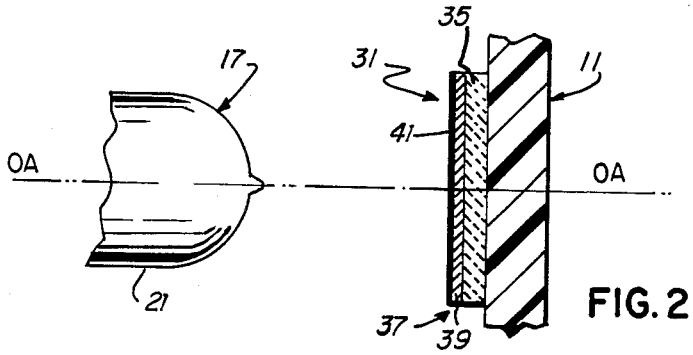
FIG. 2 is an enlarged, partial side view, in section, of the headlight of FIG. 1, illustrating the means for preventing light transmission and heat buildup of the invention in greater detail.

In FIG. 2, means 31 is shown in a much larger scale to provide better illustration thereof. The tip portion of lamp 15 is also illustrated in its relative position to means 31 and lens 11. In the embodiment of FIG. 2, means 31 is shown as comprising a layer of heat insulating material 35 which is located on the internal surface of lens 11. In addition, means 31 further includes means 37 for absorbing the visible light from the adjacent lamp 17 and reflecting heat upon receipt of said visible light. Means 37 is located directly on heat insulating material 35 and includes a relatively thin layer 39 of a metallic material having thereon a dark coating 41. In one example, heat insulating material 35 comprised a layer of mica having a thickness of only about 0.030 inch, the metallic material for layer 39 was aluminum having a thickness of about 0.002 inch and the dark (opaque) light-absorbing material 41 was a coating of black paint having a thickness of only about ten to twelve microns. In overall configuration, means 31 was preferably of substantially round shape with the axis thereof coincident with optical axis OA—OA of reflector 13. In such an arrangement, the envelope 21 of adjacent lamp 15 was also of substantially cylindrical configuration, excluding the relatively flattened press-sealed end portion 25 thereof. Possessing such a round configuration, means 31 had a diameter of only about 0.400 inch whereas the outer diameter of the corresponding cylindrical envelope 21 was about 0.250 inch. Reflector 13 in turn possessed a focal point FP of about 0.300 inch.

Assembly of means 31 to lens 11 was accomplished by initially securing mica 35 to the internal surface of lens 11 by a suitable adhesive (e.g., ethylene dichloride). Subsequently, means 37 was then attached to the secured mica. Alternatively, it is of course within the scope of the invention to assemble means 31 and thereafter place the assembled means on the desired location of lens 11 prior to attachment thereof to reflector 13. In either case, the thin aluminum layer (substrate) 39 was secured to mica 35 by a suitable adhesive, such as a contact adhesive.

Figure 3:
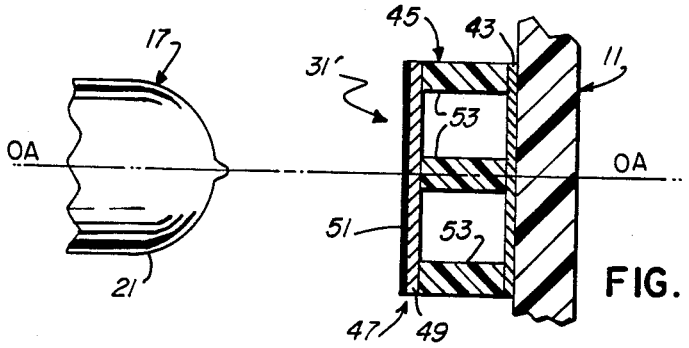
FIG. 3 is an enlarged, partial side view of an alternate embodiment of the means for preventing light transmission and heat buildup of the invention.

With particular attention to FIG. 3, there is illustrated a means 31' for preventing light transmission and heat buildup on lens 11 in accordance with an alternate embodiment of the invention. Means 31' comprises a layer of heat reflecting material 43 located on the internal surface of lens 11, heat insulating means 45 located adjacent material 43, and means 47 for absorbing the visible light from the tip portin of lamp 15 and for reflecting heat upon receipt of said visible light. As shown, means 47 is spaced from the heat reflecting material 43 by insulating means 45. In one specific example, material 43 comprised a thin layer of aluminum having a thickness of about 0.002 inch. Means 47 comprised a second, thin layer 49 of aluminum having thereon a dark coating 51 which, as shown in FIG. 3, faced lamp 15. Means 47 functions substantially the same as means 37 in the embodiment of FIG. 2 and further description is deemed not necessary. The preferred heat insulating means 45 comprises a substantially open region (or area) through which the internal atmosphere of headlight 10 will pass during headlight operation. To allow this passage while maintaining means 47 in the desired orientation, a plurality (e.g., three) of support rods 53 are utilized, said rods arranged in a substantially triangular, spaced-apart orientation to enable passage of the described atmosphere therebetween (and around). Each rod 53 is preferably of plastic or the like material and is secured at one end thereof by a suitable adhesive to the thin aluminum layer 43. Means 47, comprising the defined aluminum substrate layer 49 having the coating of black paint 51 thereon, is thus secured by a suitable adhesive to the opposing ends of each support rod. In one embodiment, each support rod 53 was comprised of a polycarbonate and possessed an overall length of only about 0.125 inch, while the corresponding thicknesses for the second aluminum layer 49 and black paint 51 were 0.002 inch and approximately ten to twelve microns, respectively. Accordingly, means 31' possessed an overall thickness of only about 0.130 inch. In addition, means 31' possessed a substantially round configuration as did means 31 in FIG. 2, and likewise possessed a diameter of only about 0.400 inch. And, as with means 31, the central axis of this component coincided with the optical axis OA—OA of reflector 13 such that the optical axis passed directly through the center thereof.

In the embodiment of FIG. 3, the first aluminum layer 43 was preferably applied using a suitable adhesive such as described above. The adhesive utilized to secure means 47 to each of the plastic rods 53, as well as for securing the opposing ends of the rods to the first layer 43, was also that described above. Assembly of means 31' can be achieved by initially depositing or positioning the layer 43 on lens 11, thereafter individually positioning the support rods 53 in the described, triangular pattern, and, when secured, thereafter applying the double-layered means 47.

Figure 4:
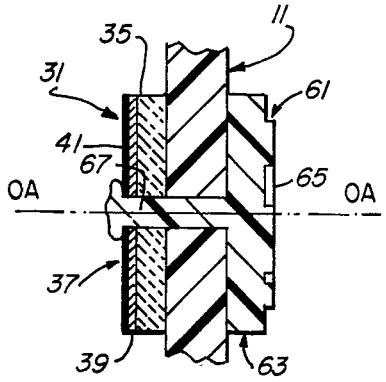
FIG. 4 is an enlarged, partial side view of another embodiment of the invention, wherein an emblem means is utilized.

In FIG. 4 there is shown yet another embodiment of the invention. Specifically, an emblem means 61 in the form of a substantially cylindrical disk 63 is provided which is located in a central position (coaxial with optical axis OA—OA) on the front (external) surface of lens 11. Means 61 preferably includes an appropriate logo, symbol or lettering 65 to indicate the manufacturer of the invention. Means 61 can also include other information separate from or in addition to the above, including, for example, operating parameters (e.g., wattage). Means 61 is secured to lens 11 by providing disk 63 with an extending pin portion 67 which passes through respective openings centrally located with lens 11 and means 31. In assembly, disk 63 is positioned on lens 11 such that pin portion 67 will pass through and extend from the internal surface of the lens. Means 31 (e.g., the mica material 35 and the thin aluminum layer 39 having the coating 41 of black paint thereon) is then located over the extending pin portion 67, whereupon heat is applied to the extreme end of portion 67, causing it to deform (melt). As a result, a rivet or the like is formed to effectively secure means 31 in position as well as provide effective retention of the main body portion of disk 63 against the external lens surface. A suitable material for means 61 is plastic (e.g, the aforementioned polycarbonate or mineral-filled nylon). Such a plastic is understandably of the high temperature variety.

Headlights using the teachings of the instant invention and possessing the dimensions and materials as cited above not only were capable of substantially reducing glare but also resulted in a significant reduction in temperature for the lens member. In one specific example, a temperature reduction from about 10 degrees to about 15 degrees Celsius was attained, based on an average operating temperature of about 115 degrees Celsius for a headlight containing a plastic lens and no heat buildup prevention means therein. The relative thicknesses of the various elements depicted in the drawings are provided for illustrative purposes only and are thus not meant to limit the invention. Specifically, the respective thicknesses as illustrated may not be to exact scale and thus representative of those values provided above.

While there have been shown what are at present considered to be the preferred embodiments of the invention, it will be apparent to those skilled in the art that various changes and modifications can be made herein without departing from the scope of the invention as defined by the appended claims.

What is claimed is:

1. In an automobile headlight including a reflector, a plastic lens secured to said reflector, and a light source in the form of a capsule disposed within and substantially surrounded by said reflector, the improvement comprising:

means located on or forming part of a preselected portion of said plastic lens for preventing transmission of visible light through said preselected portion of said lens to reduce glare when said headlight is in operation in an automobile and for preventing heat buildup on said lens during said operation, said means located adjacent said capsule and preventing direct light from a portion of said capsule from passing through said lens, said means including a layer of heat insulating material located on an internal surface of said lens relative to said capsule light source and means for absorbing visible light and reflecting heat upon receipt of said visible light, said light absorbing and heat reflecting means located on said layer of heat insulating material.

2. The improvement according to claim 1 further including emblem means secured to an external surface of said lens relative to said means for preventing light transmission and heat buildup.

3. The improvement according to claim 1 wherein said heat insulating material is mica and said light absorbing and heat reflecting means comprises a layer of aluminum located on said mica and having a dark coating thereon.

4. The improvement according to claim 3 wherein said dark coating is black paint.

5. In an automobile headlight including a reflector, a plastic lens secured to said reflector, and a light source in the form of a capsule disposed within and substantially surrounded by said reflector, the improvement comprising:

means located on or forming part of a preselected portion of said plastic lens for preventing transmission of visible light through said preselected portion of said lens to reduce glare when said headlight is in operation in an automobile and for preventing heat buildup on said lens during said operation, said means located adjacent said capsule and preventing direct light from a portion of said capsule from passing through said lens. said means for preventing light transmission and heat buildup including a layer of heat reflecting material located on an internal surface of said lens relative to said light source, heat insulating means located adjacent said layer of heat reflecting material, and means for absorbing visible light and reflecting heat upon receipt of said visible light, said light absorbing and heat reflecting means spaced from said layer of heat reflecting material by said heat insulating means.

6. The improvement according to claim 5 wherein said heat reflecting material includes a first layer of aluminum, said light absorbing and heat reflecting means comprises a second layer of aluminum having a dark coating thereon, and said heat insulating means includes a substantially open area through which the internal atmosphere of said headlight can pass during said headlight operation.

7. The improvement according to claim 6 wherein said dark coating is black paint.

8. The improvement according to claim 6 further including a plurality of support rods secured at one end to said first layer of aluminum in a spaced-apart relationship, said second layer of aluminum being positioned on a second, opposing end of each of said support rods, said atmosphere of said headlight passing around and between said support rods.

9. The improvement according to claim 8 wherein each of said support rods is comprised of plastic.

10. The improvement according to claim 1 wherein said capsule comprises a tungsten halogen capsule located substantially along the optical axis of said reflector in a direction toward said lens, said means for preventing light transmission and heat buildup being centrally disposed on said lens.

11. The improvement according to claim 2 wherein said emblem means passes through both said plastic lens and said means for preventing light transmission and heat buildup for securing said means on said internal surface of said lens.

12. The improvement according to claim 2 wherein said emblem means is plastic.

* * * * *